US005097188A

United States Patent [19]

Nakase et al.

[11] Patent Number: 5,097,188

[45] Date of Patent: Mar. 17, 1992

[54] MOTORIZED AUTOMOBILE ANTENNA CONTROL DEVICE

[75] Inventors: Kazuhiko Nakase, Tokyo; Yuji Maeda, Kanagawa, both of Japan

[73] Assignee: Harada Kogyo Kabushiki Kaisha, Tokyo, Japan

[21] Appl. No.: 630,066

[22] Filed: Dec. 11, 1990

Related U.S. Application Data

[63] Continuation of Ser. No. 281,178, Dec. 7, 1988, abandoned.

[30] Foreign Application Priority Data

Dec. 8, 1987 [JP] Japan ..... 62-310080

[51] Int. Cl.[5] ..... H01Q 1/10

[52] U.S. Cl. ..... 318/466; 318/434; 318/266

[58] Field of Search ..... 318/255, 256, 264, 265, 318/266, 280, 283, 284, 285, 286, 293, 434, 445, 452, 466, 467, 468, 469

[56] References Cited

U.S. PATENT DOCUMENTS 4,203,059 5/1980 Kraus ..... 318/446
4,338,552 7/1982 Pilz et al. ..... 318/284 X
4,414,551 11/1983 Tadauchi et al. ..... 343/903
4,514,670 4/1985 Fassel et al. ..... 318/284 X
4,575,662 3/1986 Lehnhoff ..... 318/293 X
4,649,398 3/1987 Yamamoto et al. ..... 343/903
4,672,278 6/1987 Ingraham et al. ..... 318/286 X
4,725,765 2/1988 Miller ..... 318/434
4,730,152 3/1988 Foust et al. ..... 318/603
4,733,101 3/1988 Graham et al. ..... 307/10 R
4,749,924 6/1988 Watanabe et al. ..... 318/466 X
4,864,322 9/1989 Yamamoto et al. ..... 343/903

*Primary Examiner*—Bentsu Ro
*Attorney, Agent, or Firm*—Koda & Androlia

[57] ABSTRACT

A control device which raises and lowers a motorized automobile antenna by means of an antenna up-down switch, the power supply for a motor which drives the antenna being cut off when the antenna has reached its highest or lowest point and such a position of the antenna is detected. By supplying a voltage from the automobile ignition key to a control circuit when the antenna up-down switch is in a neutral position, the antenna is operated by the antenna up-down switch only when the automobile ignition key is on, and when the automobile ignition key is switched off, the antenna is retracted by a trigger which is actuated when the input of the control circuit reaches zero.

4 Claims, 3 Drawing Sheets

MOTORIZED AUTOMOBILE ANTENNA CONTROL DEVICE

This is a continuation of application Ser. No. 281,178, filed Dec. 7, 1988, now abandoned.

BACKGROUND OF THE INVENTION

1. Field of the Invention

The present invention relates to a motorized automobile antenna control device in which an antenna is raised or lowered by means of an antenna up down switch.

2. Prior Art

A motorized automobile antenna control device wherein an antenna is raised and lowered by means of an antenna up-down switch has been known conventionally. In the conventional device, when the antenna up-down switch remains depressed, even after the antenna has reached its highest or lowest point, the antenna driving motor is locked and stops. Thus, a large amount of excess current flows to the motor, resulting in burning damage to the motor.

In order to prevent such burning damage, a clutch is often used between the antenna driving motor and the antenna driving mechanism so that the antenna driving mechanism is caused to slip by means of the clutch when the antenna has reached its highest or lowest point.

Alternately, limit switches may also be used. A system which uses limit switches is designed such that the motor current is automatically cut off when the antenna has reached its highest or lowest point and the limit switches are actuated.

However, installation of clutches or limit switches in antenna control devices so as to prevent burning damage, for example, to the motor, makes the device more complex. Furthermore, the antenna is likely to be damaged if the automobile is parked and the antenna is left extended.

SUMMARY OF THE INVENTION

Accordingly, it is a general object of the present invention to solve the problems of conventional antenna control devices.

In the control device of the present invention, a motorized automobile antenna is raised and lowered by means of an antenna up-down switch. A power supply for the motor which drives the antenna is cut off when the antenna has reached its highest or lowest point. In addition, the antenna is automatically retracted when the automobile ignition key is switched off so that accidents such as burning damage to the motor, etc. are prevented via a simple structure.

Furthermore, according to the present invention voltage from the automobile ignition key is supplied to a control circuit input when the antenna up-down switch is in a neutral position. Thus, extension and retraction (or raising and lowering) of the antenna via the antenna up-down switch is possible only when the automobile ignition key is in the "ON" position. When the automobile ignition key is switched off the antenna is retracted via a trigger which is actuated when the control circuit input drops to zero.

DETAILED DESCRIPTION OF THE INVENTION

Figure 1:
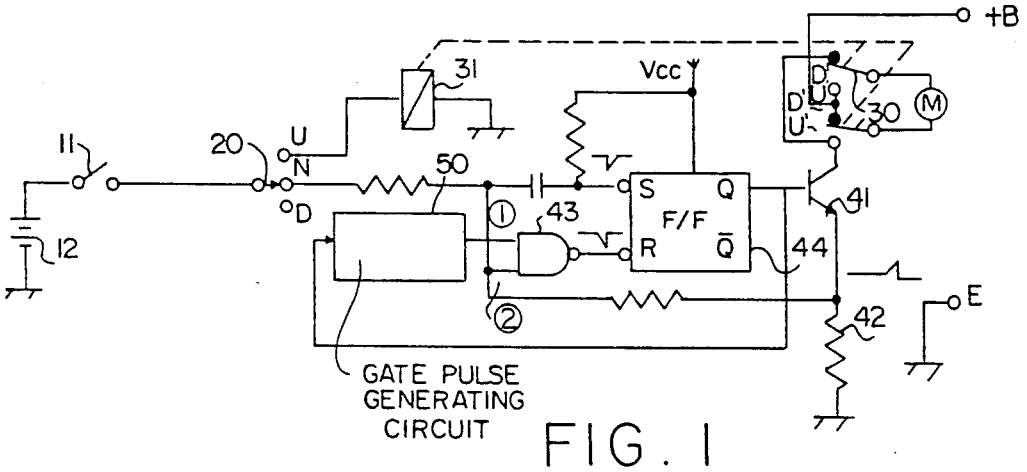
FIG. 1 is a circuit diagram which illustrates one embodiment of the present invention.

FIG. 1 is a circuit diagram which illustrates one embodiment of the present invention.

This embodiment of an antenna control system of the present invention includes an engine ignition key 11, a battery 12, an antenna up-down switch 20 which actuates a motorized automobile antenna (not shown in the Figures) which is raised and lowered, and a relay 31 which is provided with contacts 30. The antenna control system further includes a motor M which drives the motorized automobile antenna, a transistor 41 which is used for a motor current controller, and a positive-characteristic temperature-resistance element 42 which is connected in series to the transistor 41, as well as a NAND gate 43, a flip-flop 44, and a gate pulse generating circuit 50.

The positive characteristic temperature-resistance element 42 is an example of a detection means for detecting whether the motorized automobile antenna has reached its highest or lowest point during the raising and lowering of the antenna.

Furthermore, the flip-flop 44 and transistor 41 constitute an example of a motor power supply cut-off means for cutting off the power supply to the motor, which drives the motorized automobile antenna, when the antenna has reached its highest or lowest point.

When the antenna up-down switch 20 is switched to the U (up) terminal, the relay 31 is activated. As a result, the contacts 30 of the relay 31 are connected to the terminals U', and the motor M is caused to turn in the direction which raises the motorized automobile antenna.

When the antenna up-down switch 20 is switched to the N (neutral terminal or the D (down) terminal, activation of the relay is stopped. As a result, the contacts 30 of the relay 31 are connected to terminals D', and the motor M turns in the direction which lowers the motorized automobile antenna.

When the automobile ignition key 11 is switched of while the antenna up-down switch 20 is at the N terminal, the flip-flop 44 is set and thus switches on the transistor 41.

The gate 43 generates a reset pulse which resets the flip-flop 44. The reset pulse is generated when the voltage of the element 42 exceeds a predetermined level due to the motorized antenna reaching its highest or lowest point which occurs when the antenna up-down switch 20 is switched to the U terminal or D terminal and the motor M is rotated.

The transistor 41 actuates the motor M when the flip-flop 44 is set and cuts off the power supply to the motor M when the flip-flop 44 is reset.

The gate pulse generating circuit 50 prevents a reset pulse from being supplied to the flip-flop 44 even if the terminal voltage of the element 42 should exceed the predetermined level as a result of a current surge. This is necessary in order to prevent erroneous operation due to a current surge during the starting of the motor M.

Figure 2:
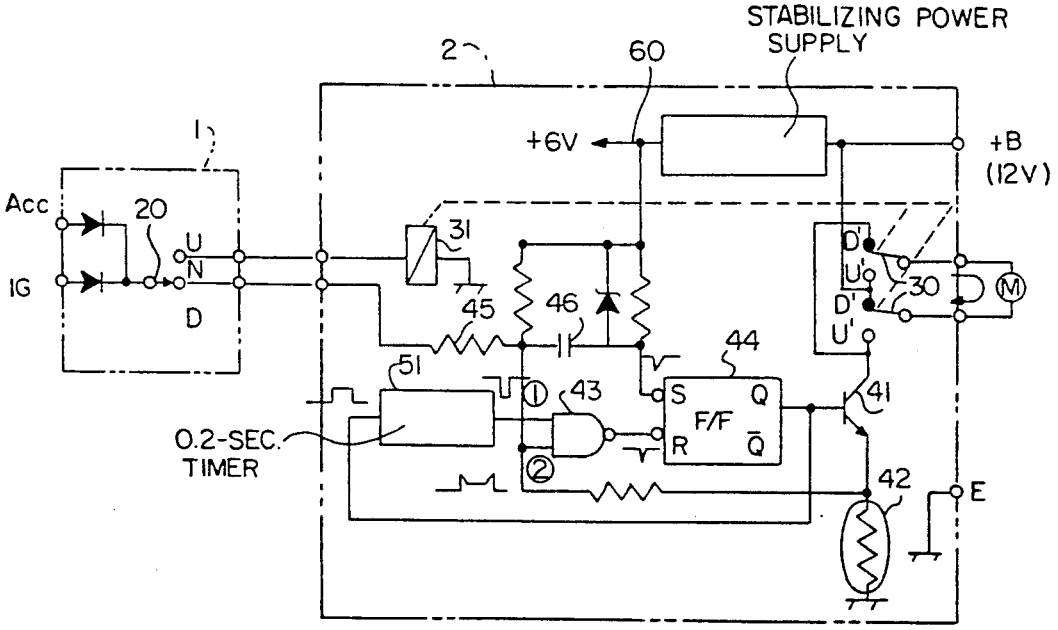
FIG. 2 is a circuit diagram which illustrates the embodiment of FIG. 1 more concretely.

FIG. 2 is a circuit diagram of the abovementioned embodiment shown in a more concrete manner.

In FIG. 2, diode, which is installed between the antenna up-down switch 20 and the ACC (accessory power supply), and a diode which is installed between the antenna up-down switch 20 and the IG (ignition), are provided in an operating panel 1. All parts except for this operating panel 1 and the motor M are provided in a control box 2. Furthermore, a 0.2-second timer is used as a circuit corresponding to the gate pulse generating circuit 50 of FIG. 1.

The operation of the above-described embodiment will be explained in conjunction with the time chart shown in FIG. 3.

First, at to, the automobile ignition key 11 is switched on with the antenna up-down switch 20 in the neutral position (i.e., in the N terminal).

Then, when the antenna up-down switch 20 is switched to the U terminal at $t_1$, the relay 31 is excited, and the contacts 30 of the relay 31 are switched to the terminals U'. As a result, the polarity of the motor M is set such that the motor will turn in the direction which raises the motorized antenna. At this time, the N terminal of the antenna up-down switch 20 opens, and the N terminal voltage becomes L (low). Accordingly, the flip-flop 44 is set, and the transistor 41 is switched on so that the motor M begins to turn with the electric current flowing in the direction indicated by the arrow 60 in FIG. 2. Thus, the motorized antenna is raised.

When the antenna reaches its highest point at $t_2$, the terminal voltage of the element 42 exceeds a predetermined level. As a result, the input 2 of the gate 43 becomes H (high). At this time, also the input 1 of the gate 43 has become H. Accordingly, the gate 43 outputs a negative pulse, the flip-flop 44 is reset, and the transistor 41 is switched off so that the motor M stops.

Thus, even the antenna up-down switch 20 remains switched to the U terminal after the antenna has reached its highest point, the power supply to the motor M can be cut off. Accordingly, no burning damage occurs to the motor.

Afterward, when the antenna up-down switch 20 is brought back to the neutral position (i. e., the N terminal) at $t_3$, the motorized antenna ramains kept extended. Since the relay 31 is no longer excited at this time, the contacts 30 of the relay 31 are connected to the terminals D', and the polarity of the motor M is reversed.

When the antenna up-down switch 20 is switched to the D terminal at $t_4$, the N terminal voltage becomes L, the flip-flop 44 is reset, and the transistor 41 is switched on. Thus, the motor M begins to turn. In this case, since the relay 31 remains unactivated, the contacts 30 are connected with the terminals D', so that the motor M is connected with a polarity which causes the motorized antenna to be lowered. Accordingly, current flows to the motor in a direction opposite to that indicated by the arrow 60 in FIG. 2, and the motorized antenna is lowered.

Then, at $t_{11}$, if the antenna up-down switch 20 is returned to the neutral position (N terminal) during the lowering of the motorized antenna, the N terminal of the antenna up-down switch 20 becomes H. Accordingly, the input 2 of the gate 43 becomes H. Since the 0.2-second timer 51 is not being activated, the output signal of the timer (the input 1 of the gate 43) is also H. As a result, the gate 43 generates a negative pulse, the flip-flop 44 is reset, and the transistor 41 is switched off. Thus, the power supply to the motor M is cut off, and the height of the antenna at this time is maintained.

At $t_{12}$, if the automobile ignition key 11 is removed or switched off under the above conditions, the N terminal of the antenna up-down switch 20 becomes L, and the flip-flop 44 is set, the transistor 41 is switched on, and the motor M is powered. Since the relay 31 is not being activated at this time, the contacts 30 are connected to the terminals D', and the motor current flows in a direction opposite to that indicated by the arrow 60 in FIG. 2. Accordingly, the motorized antenna is lowered.

At $t_{13}$, when the antenna reaches its lowest point, the motor current exceeds a predetermined level, the terminal voltage of the element 42 rises above the predetermined level, and the input 2 of the gate 43 becomes H. At this moment, the input 1 of the gate 43 has become H. As a result, the gate 43 generates a negative pulse, the flip-flop 44 is reset, and the transistor 41 is switched off. Thus, the power supply to the motor M is cut off.

As seen from the above description, in the present invention merely removing the automobile ignition key is enough to cause automatic retraction of the motorized antenna. In other words, the motorized antenna is easily retracted or lowered when one gets out of the automobile. Furthermore, since the current to the motor M is automatically cut off when the motorized antenna reaches its lowest point, no burning damage to the motor M occurs.

Figure 3:
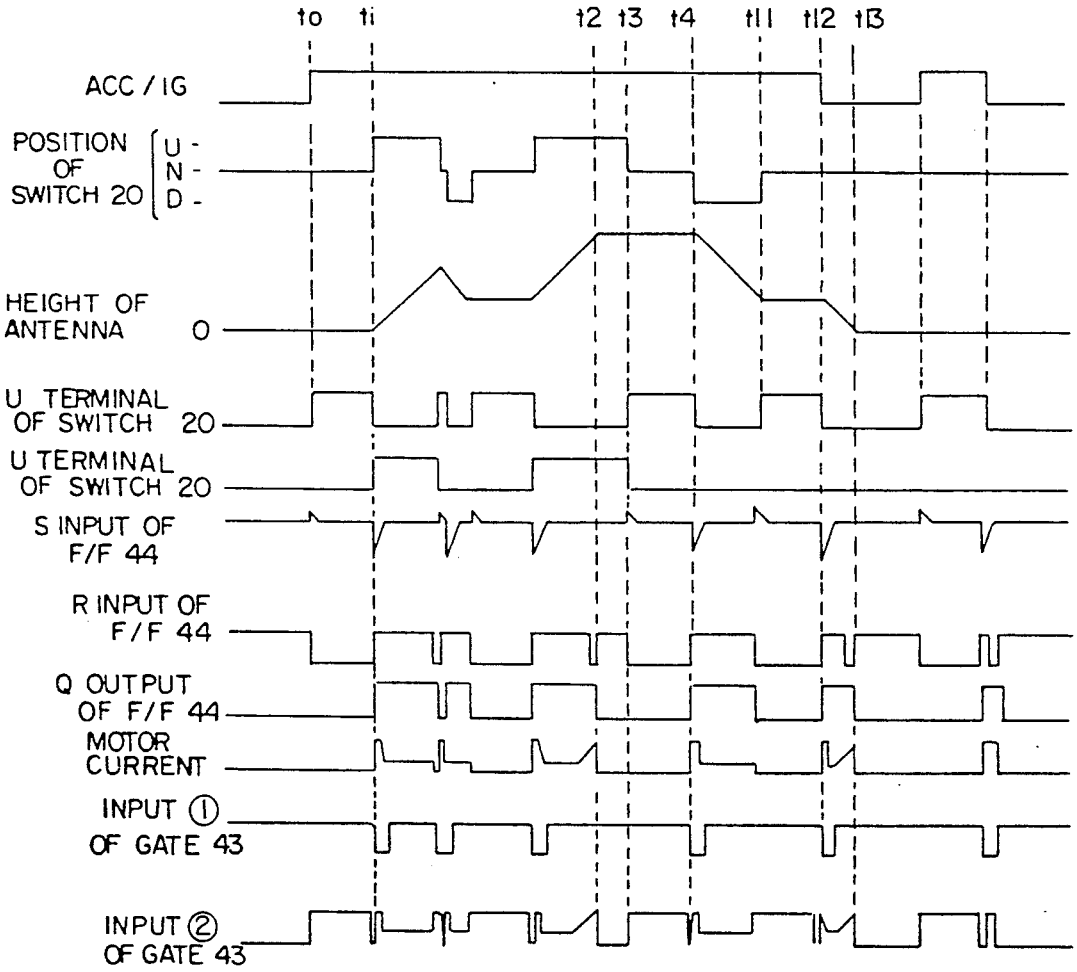
FIG. 3 is a time chart indicating the operation of the embodiment of the present invention.

If the antenna up-down switch 20 is switched from the U terminal to the N terminal between $t_1$ and $t_2$ in FIG. 3, the height of the antenna at the time is maintained "as is." If the antenna up-down switch 20 is switched from the N terminal to the D terminal, the motorized antenna is lowered. Then, if the antenna up-down switch 20 is switched to the U terminal, the motorized antenna is raised again.

Furthermore, even if current surge is generated when the motor M is started, and this current surge should cause the terminal voltage of the element 42 to exceed the predetermined level, the 0.2-second timer 51 will generate a negative pulse for 0.2 seconds. Accordingly, no negative pulse will be generated by the gate 43, and, therefore, no erroneous resetting of the flip-flop 44 will occur.

In addition, a timer which can be set at a time other than 0.2 seconds may also be used in this invention.

Figure 4:
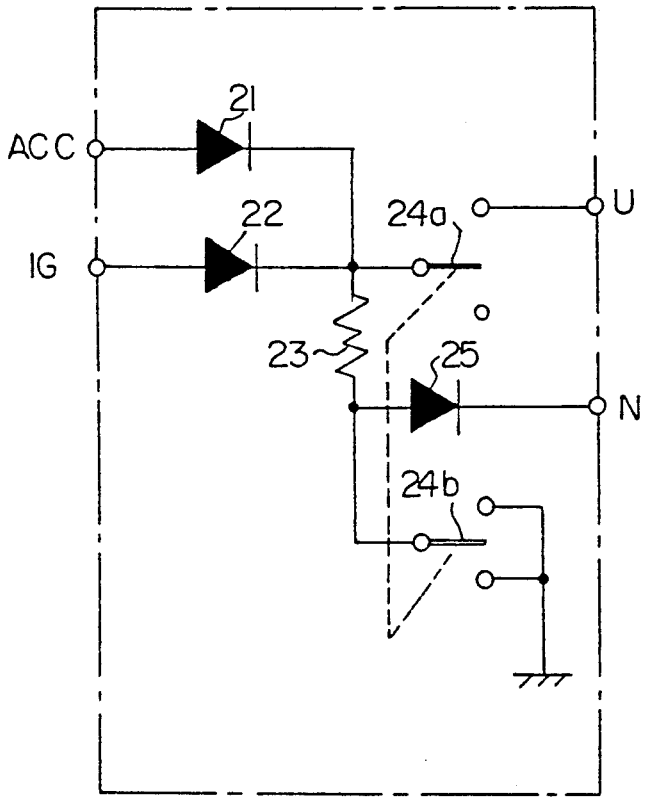
FIG. 4 is a circuit diagram which illustrates a modification of an operating panel in the embodiment of the present invention.

FIG. 4 illustrates a modification of the operating panel 1 illustrated in FIG. 2.

In this modification, two linked switches 24*a* and 24*b* are provided instead of the antenna up-down switch 20 which has a neutral contact. A resistor 23 and diode 25 are provided between the two switches 24*a* and 24*b*. This arrangement operates in the same manner as the antenna up-down switch 20.

As described in detail above, according to the present invention, a motorized automobile antenna is raised and lowered by means of an antenna up-down switch without causing adverse affects such as burning damage to the motor, etc., and the antenna can be automatically lowered or retracted by means of a simple structure when the automobile ignition key is switched off.

We claim:

1. A motorized automobile antenna control device which controls raising and lowering of an automobile antenna to extend or retract said antenna, said antenna control device comprising:

a detection means which detects whether said automobile antenna has reached its highest point or lowest point during the raising and lowering of said antenna;

a motor power supply cut-off means for cutting off a power supply for a motor, which drives said automobile antenna, when said antenna has reached its highest or lowest point of extension or retraction respectively, said motor power supply cut-off means comprising a means for sensing when a motor current exceeds a predetermined level when said automobile antenna has reached said highest or lowest point of extension or retraction respectively; and an antenna up-down switch which actuates said motor to make positive rotation, reverse rotation and stop, said antenna up-down switch comprising antenna up, antenna down and an antenna stop neutral positions wherein said antenna raises when said antenna up-down switch is in said antenna up position, lowers when said antenna up-down switch is in said antenna down position and lowers when an ignition switch is turned off while said antenna up-down switch is in said stop neutral position.

2. A device according to claim 1, wherein said motor power supply cut-off means further comprises motor power supplying means.

3. A device according to claim 2, wherein said motor power supply cut-off means comprises a power transistor which is connected in series to said motor.

4. A device according to claim 1 wherein a means for generating trigger pulses for controlling said motor power supply cut-off means is provided, said generating means generating a trigger pulse to cause said motor power supply cut-off means to supply power to said motor when said antenna up-down switch is in said antenna up position and antenna down position or said stop neutral position with said ignition switch turned off, and generating a trigger pulse to cause said motor power supply cut-off means to cut off power to said motor when said antenna up-down switch is in said stop neutral position with said ignition switch turned on or said detection means detects said highest or lowest point of extension or retraction respectively.

* * * * *